United States Patent [19]

Boda

[11] Patent Number: 4,718,625

[45] Date of Patent: Jan. 12, 1988

[54] WALL MOUNTING SYSTEM WITH BASE AND DETACHABLE BRACKET

[75] Inventor: John W. Boda, Roscoe, Ill.

[73] Assignee: Amerock Corporation, Rockford, Ill.

[21] Appl. No.: 19,435

[22] Filed: Feb. 26, 1987

[51] Int. Cl.[4] ..... E04G 5/06

[52] U.S. Cl. ..... 248/222.1; 248/225.2

[58] Field of Search ..... 248/222.1, 223.3, 223.4, 248/225.2, 224.4, 224.1; 312/246, 249; 211/87, 105.1, 105.2

[56] References Cited

U.S. PATENT DOCUMENTS

| | | | |
|---|---|---|---|
| 2,127,230 | 8/1938 | Moineau | 248/221.3 |
| 2,299,320 | 10/1942 | Hallenscheid | 248/222.1 |
| 2,315,955 | 4/1943 | Hallenscheid | 248/222.1 |
| 2,506,602 | 5/1950 | Laystrom et al. | 248/222.1 X |
| 3,036,803 | 5/1962 | Fiebelkorn | 248/221.3 |
| 3,596,861 | 8/1971 | Baldini | 248/223.4 |
| 4,618,117 | 10/1986 | Gerbe | 248/222.1 |

FOREIGN PATENT DOCUMENTS

| | | | |
|---|---|---|---|
| 255070 | 6/1967 | Austria | 248/221.3 |

*Primary Examiner*—J. Franklin Foss

*Attorney, Agent, or Firm*—Leydig, Voit & Mayer

[57] ABSTRACT

A household fixture such as a towel bar includes a dish-shaped bracket which is adapted to be assembled detachably with a concealed mounting base. The mounting base is adapted to be secured rigidly to a wall and includes a spring-loaded U-shaped member with legs which interlock with the bracket when the bracket is shifted into assembled relation with the base.

5 Claims, 6 Drawing Figures

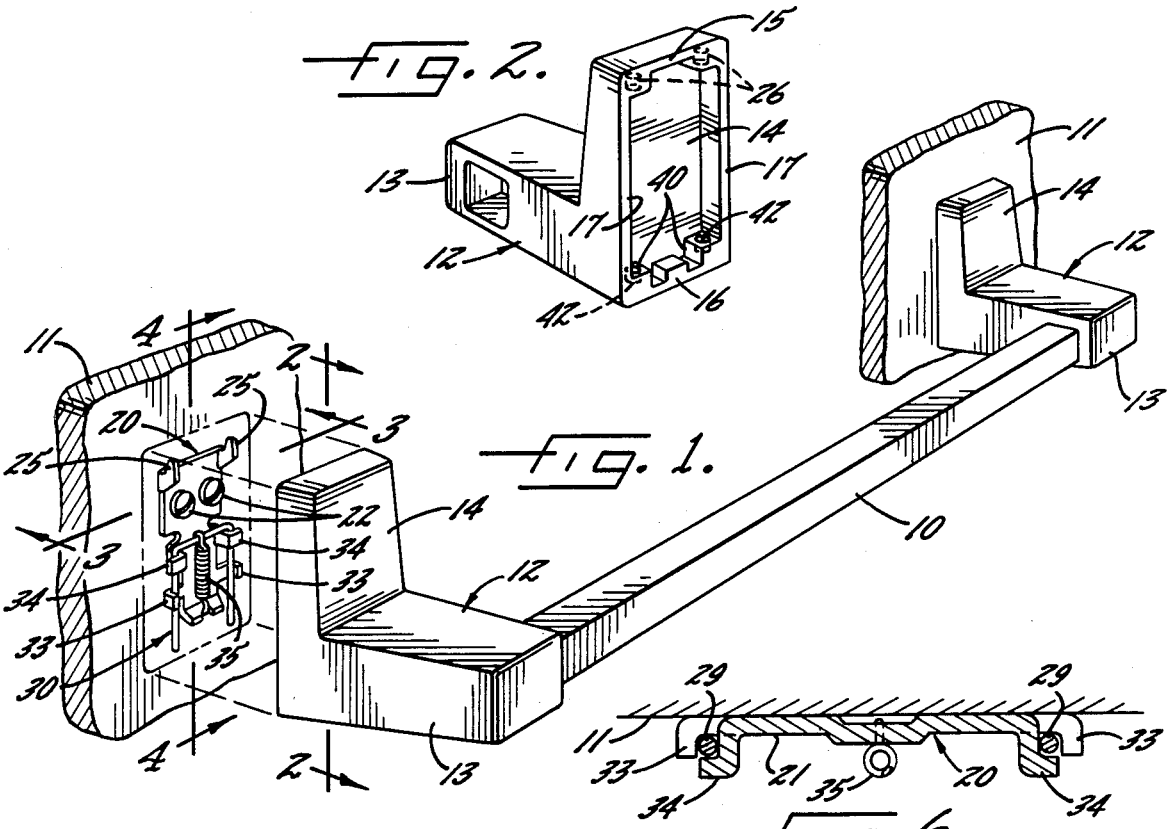
Fig. 2.
Fig. 1.
Fig. 6.
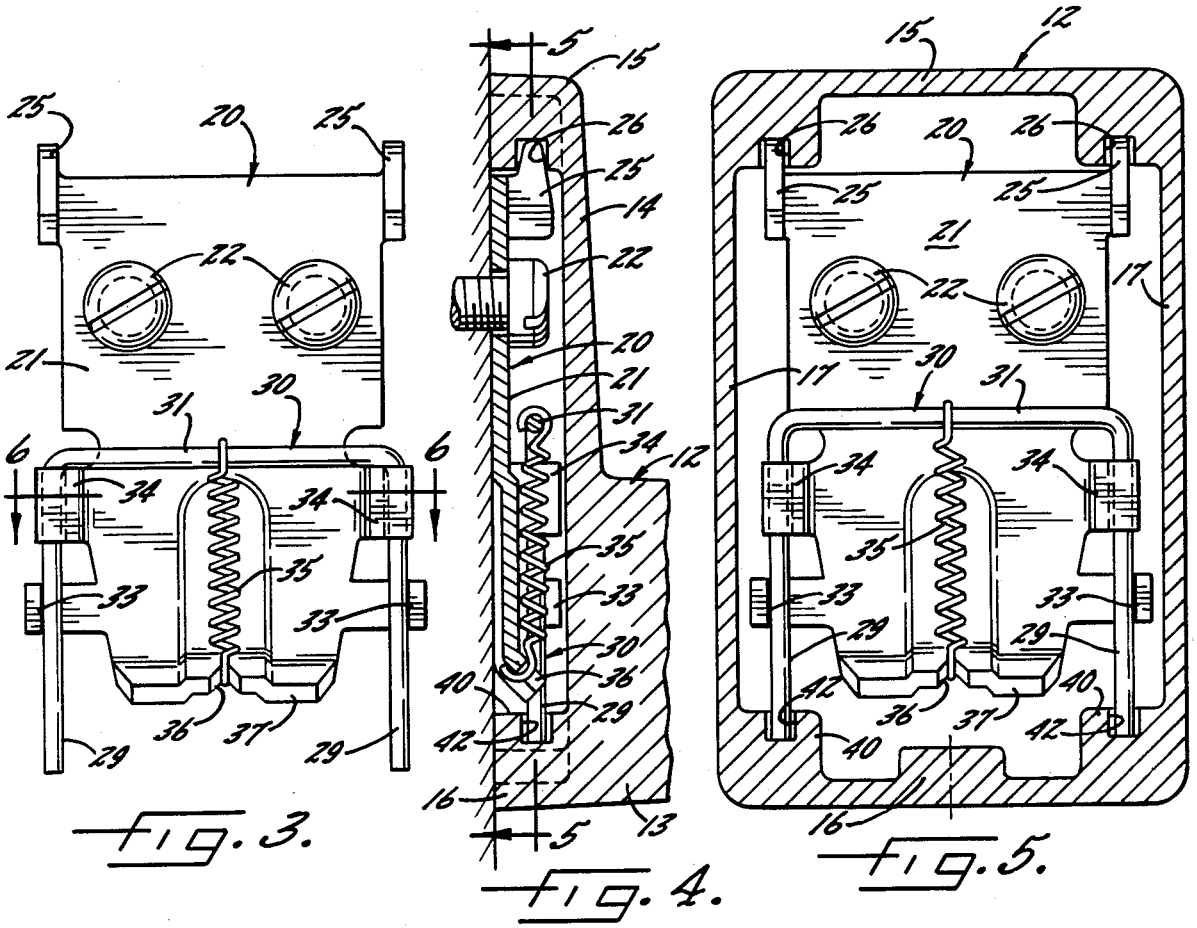
Fig. 3.
Fig. 4.
Fig. 5.

WALL MOUNTING SYSTEM WITH BASE AND DETACHABLE BRACKET

BACKGROUND OF THE INVENTION

This invention relates to a mounting system and, more particularly, to a mounting system comprising a base adapted to be secured rigidly to an upright wall and a bracket adapted to be secured detachably to the base.

Mounting systems of this type are used in connection with various household fixtures such as towel bars, soap dishes, tumbler holders and the like. The base of such a system usually comprises a relatively flat and generally rectangular plate while the bracket includes a generally dish-shaped member of sufficient size to receive and conceal the plate. After the base plate has been secured rigidly to the wall by anchoring screws or the like, the bracket is placed over and is attached to the plate. Usually, the final attachment of the bracket to the base plate is effected by a set screw which extends through a tapped hole in the lower end portion of the bracket.

SUMMARY OF THE INVENTION

The general aim of the present invention is to provide a new and improved mounting system of the above type in which the bracket is adapted to be fastened securely but releasably onto the base plate so as to simplify installation of the bracket while eliminating the need for the set screw and the tapped hole. The mounting system of the invention is particularly advantageous for use under crowded conditions where obstructions would make it difficult to gain access to the set screw with a driving tool.

A more detailed object of the invention is to achieve the foregoing by providing a mounting system in which the base plate includes novel spring-loaded detent means which automatically interlock with the dish-shaped bracket as an incident to moving the bracket into telescoping relation with the base plate.

The invention also resides in the unique construction of the detent means permitting the detent means to interlock with the bracket at two laterally spaced locations while requiring only a single spring for urging the detent means into interlocking engagement with the bracket.

These and other objects and advantages of the invention will become more apparent from the following detailed description when taken in conjunction with the accompanying drawings.

BRIEF DESCRIPTION OF THE DRAWINGS

FIG. 1 is an exploded perspective view showing a typical bathroom fixture adapted to be attached to a wall by a new and improved mounting system incorporating the unique features of the present invention.

FIG. 2 is a rear perspective view of one of the brackets of the fixture, the view being taken substantially along the line 2—2 of FIG. 1.

FIG. 3 is a front elevational view taken substantially along the line 3—3 of FIG. 1 and showing a base plate adapted to coact with the bracket illustrated in FIG. 2.

FIG. 4 is an enlarged fragmentary cross-section taken substantially along the line 4—4 of FIG. 1.

FIG. 5 is a cross-section taken substantially along the line 5—5 of FIG. 4.

FIG. 6 is a cross-section taken substantially along the line 6—6 of FIG. 3.

DETAILED DESCRIPTION OF THE PREFERRED EMBODIMENT

For purposes of illustration, the invention is shown in the drawings as being embodied in a system for attaching a fixture such as a towel bar 10 to an upright wall 11. In this instance, the end portions of the towel bar are supported by brackets 12 which form part of the mounting system.

Each of the mounting brackets 12 is a generally L-shaped die casting and includes a generally horizontal and outwardly extending leg 13 for supporting the end portion of the bar 10. Extending upwardly from the rear end of the horizontal leg 13 is a generally dish-shaped member 14 which opens inwardly toward the wall 11. The dish-shaped member 14 includes an upper rim portion 15, a lower rim portion 16 and laterally spaced side rim portions 17 (FIGS. 2 and 5).

One component of the mounting system is formed by a bracket 12 while a second component is formed by a base 20 adapted to be attached securely to the wall 11 and adapted to support the bracket. Herein, the base 20 includes a relatively flat and generally rectangular plate 21 which may be blanked and formed from sheet metal. The base plate 21 is secured to the wall by a pair of laterally spaced anchoring screws 22 which extend through holes in the plate. The rectangular dimensions of the base plate 21 are smaller than the rectangular dimensions of the dish-shaped member 14 of the bracket 12 and thus the base plate is adapted to be received within and concealed completely by the dish-shaped member.

Hook means at the upper end of the base plate 21 coact with the dish-shaped member 14 of the bracket 12 to prevent the bracket from shifting downwardly relative to the plate and also to prevent the upper end portion of the bracket from shifting outwardly and laterally relative to the plate. In this particular instance, the hook means are formed by two laterally spaced and upwardly extending hooks 25 formed integrally with the upper corners of the plate 21. The hooks are adapted to be received within a pair of laterally spaced recesses or holes 26 (FIGS. 4 and 5) formed in the lower side of the upper rim 15 of the dish 14. By shifting the bracket 12 downwardly, the hooks 25 enter the holes 26 and cause the bracket to hang from the plate 21.

In accordance with the present invention, the base 20 is equipped with novel detent means which interlock with the lower end portion of the bracket 12 so as to secure the bracket releasably but securely to the base. As a result of the detent means, the bracket may be assembled automatically with the base and without need of using any fasteners or tools to effect the assembly.

In the present instance, the detent means are defined by the lower end portions of a pair of laterally spaced and vertically extending legs 29 which form part of a U-shaped member 30 made from a single piece of round wire. In addition to the vertically extending legs 29, the U-shaped member 30 includes a generally horizontal bridge 31 formed integrally with and extending between the upper ends of the legs.

The U-shaped member 30 is supported for up and down movement on the base plate 21. For this purpose, tabs 33 are struck outwardly from the base plate adjacent the lower end thereof and engage the outboard sides of the legs 29. In addition, generally L-shaped tabs 34 are struck out from the plate in upwardly spaced relation from the tabs 33. Each of the tabs 34 extends outwardly along the inboard side of a leg 29 and then wraps around the outer side of the leg (see FIG. 6). By virtue of the coaction of the tabs 33 and 34, the U-shaped member 30 is held against lateral and outward movement but is permitted to slide upwardly and downwardly. In addition, the tabs 34 limit downward shifting of the U-shaped member 30 beyond a predetermined position by virtue of the tabs engaging the underside of the bridge 31.

The base 20 is completed by a contractile spring 35 which urges the U-shaped member 30 downwardly to an active position. The upper end of the spring is hooked around the bridge 31 at the center thereof while the lower end of the spring is hooked within a notch 36 (FIG. 3) formed in a flange 37 which is bent outwardly from the lower end portion of the plate 21.

To assemble the bracket 12 with the base 20, the bracket is positioned such that surfaces 40 (FIGS. 2 and 4) on the upper side of the lower rim 16 engage the lower ends of the legs 29. The bracket then is shifted upwardly to cause the surfaces 40 to shift the U-shaped member 30 upwardly and to lift the lower side of the upper rim 15 to an elevation above the upper ends of the hooks 25. Thereafter, the bracket 12 is pushed inwardly and is lowered. As a result, the hooks 25 enter the holes 26 to attach the upper end portion of the bracket to the base 20 and, at the same time, the surfaces 40 shift inwardly past the lower ends of the legs 29 to cause the legs to become alined with laterally spaced recesses or holes 42 (FIGS. 4 and 5) formed in the upper side of the lower rim 16. When the legs 29 become fully alined with the holes 42, the spring 35 forces the U-shaped member 30 downwardly and causes the lower end portions of the legs to snap downwardly into the holes. The legs 29 thus coact with the holes 42 to secure the lower end portion of the bracket 12 securely to the base 20. The bracket may be disassembled from the base but only by positively shifting the bracket upwardly against the action of the spring 35 until the lower surface of the upper rim 15 clears the upper ends of the hooks 26 and then by swinging the upper end portion of the bracket outwardly. Thus, once assembled, the bracket will stay assembled until intentionally disassembled by a positive lifting action.

From the foregoing, it will be apparent that the present invention brings to the art a new and improved mounting system which allows the bracket 12 to be assembled securely but detachably to the base 20 with a simple installation motion. Thus, no fasteners are required to effect the assembly nor is there need for using any tools. This is particularly advantageous where space limitations might make it difficult or impossible to locate the tool in a proper position to tighten a fastener.

The U-shaped member 30 is of simple and inexpensive construction and its legs 29 define two laterally spaced detents for holding the bracket 12 at two laterally spaced locations so as to prevent the lower end portion of the bracket from shifting laterally as well as outwardly. Even though the legs define a pair of spring-loaded detents, only a single spring 35 is required.

With the particular bracket 12 which has been illustrated, a lifting action is imparted to the bracket to cause the surfaces 40 to raise the U-shaped member 30 prior to the legs 29 snapping downwardly into the holes 42. It should be appreciated that the bottoms of the holes 42 could be used to lift the U-shaped member 30 during installation. Alternatively, the surfaces 40 could be formed as inclined cam surfaces to cause lifting of the U-shaped member 30 as an incident to the lower end portion of the bracket being swung inwardly about a horizontal axis extending between the upper ends of the hooks 26.

I claim:

1. The combination of, a base adapted to be secured rigidly to an upright wall, and a bracket adapted to be secured detachably to said base, said base and said bracket each having upper and lower end portions, coacting means on the upper end portions of said base and said bracket and adapted to engage one another to prevent said bracket from moving downwardly relative to said base and to prevent the upper end portion of said bracket from moving outwardly relative to said base, detent means supported to move upwardly and downwardly on the lower end portion of said base, spring means on said base for urging said detent means downwardly while permitting said detent means to move upwardly, means on the lower end portion of said bracket for moving said detent means upwardly when the lower end portion of said bracket engages said detent means and is moved in a predetermined direction relative to said base, means on the lower end portion of said bracket for receiving said detent means and for interlocking with said detent means to prevent the lower end portion of said bracket from moving outwardly relative to said base, said detent means comprising a generally U-shaped member having an upper and generally horizontally extending bridge and having a pair of laterally spaced legs formed integrally with and projecting downwardly from said bridge, and said spring means comprising a contractile spring stretched between said bridge and the lower end portion of said base.

2. The combination defined in claim 1 in which said base comprises a plate and in which said bracket comprises a generally dish-shaped member having upper and lower rim portions and opposing side rim portions, said bracket being of sufficient size to receive and conceal said plate, said means for receiving said detent means comprising laterally spaced and upwardly opening recess means formed in the upper side of the lower rim portion of said bracket, for receiving the lower end portions of the legs of said U-shaped member.

3. The combination of, a base adapted to be secured rigidly to an upright wall, and a bracket adapted to be secured detachably to said base, said base comprising an upright plate having upper and lower end portions, said bracket comprising a dish-shaped member having upper and lower rim portions and of sufficient size to receive and conceal said plate, upwardly extending hook means on the upper end portion of said plate, recess means in the lower side of the upper rim portion of said bracket for receiving said hook means to prevent said bracket from moving downwardly relative to said plate and to prevent the upper end portion of said bracket from moving outwardly relative to said plate, detent means supported to move upwardly and downwardly on the lower end portion of said plate, spring means on said plate for urging said detent means downwardly while permitting said detent means to move upwardly, means on the lower rim portion of said bracket for engaging said detent means and for moving said detent means upwardly when said bracket is moved in a predetermined direction relative to said plate, recess means in the upper side of the lower rim portion of said plate for receiving said detent means when the detent means springs downwardly and for interlocking with said detent means to prevent the lower end of said bracket from moving outwardly relative to said plate, said detent means comprising a generally U-shaped member having an upper and generally horizontally extending bridge and having a pair of laterally spaced legs formed integrally with and projecting downwardly from said bridge, and said spring means comprising a contractile spring stretched between said bridge and the lower end portion of said plate.

4. The combination of, a base adapted to be secured rigidly to an upright wall, and a bracket adapted to be secured detachably to said base, said base comprising an upright plate having upper and lower end portions, said bracket comprising a dish-shaped member having upper and lower rim portions and of sufficient size to receive and conceal said plate, a pair of laterally spaced hooks on the upper end portion of said plate, a pair of laterally spaced recesses in the lower side of the upper rim portion of said bracket for receiving said hooks to prevent said bracket from moving downwardly relative to said plate and to prevent the upper end portion of said bracket from moving both laterally and outwardly relative to said plate, a generally U-shaped member comprising an upper generally horizontal bridge and a pair of laterally spaced legs formed integrally with and projecting downwardly from said bridge, said U-shaped member being supported to move upwardly and downwardly on said plate, a spring connected between said plate and said bridge and operable to urge said U-shaped member downwardly while permitting said U-shaped member to move upwardly, surface means on the upper side of the lower rim portion of said bracket for engaging the lower ends of said legs and for causing said U-shaped member to move upwardly when said bracket is moved in a predetermined direction relative to said plate, and laterally spaced recesses in the upper side of the lower rim portion of said bracket for receiving the lower ends of legs when said U-shaped member springs downwardly and for interlocking with said legs to prevent the lower end portion of said bracket from moving both laterally and outwardly relative to said plate.

5. The combination defined in claim 4 in which said spring comprises a contractile spring extending downwardly from said bridge and stretched between said bridge and the lower end portion of said plate.

* * * * *